United States Patent [19]

Leibig et al.

[11] 4,043,832

[45] Aug. 23, 1977

[54] APPARATUS FOR EXTRACTING SUBSTANCES FROM FIBROUS MATERIALS

[75] Inventors: Wilhelm J. Leibig, Aurora; Clarence R. Steele; Frank B. Price, both of Denver, all of Colo.

[73] Assignee: CF&I Engineers, Inc., Denver, Colo.

[21] Appl. No.: 673,676

[22] Filed: Apr. 5, 1976

Related U.S. Application Data

[63] Continuation of Ser. No. 232,690, March 8, 1972, abandoned, which is a continuation of Ser. No. 54,370, July 30, 1970, abandoned.

[51] Int. Cl.[2] ..... C13D 1/04; B30B 3/04; B30B 9/20

[52] U.S. Cl. ..... 127/6; 100/110; 100/121; 100/170; 127/4; 127/43

[58] Field of Search ..... 127/2-6; 100/110, 121, 170

[56] References Cited

U.S. PATENT DOCUMENTS

| | | | |
|---|---|---|---|
| 3,695,931 | 10/1972 | Hamill | 127/4 |
| 3,697,324 | 10/1972 | Steele | 127/4 X |

*Primary Examiner*—Sidney Marantz
*Attorney, Agent, or Firm*—Henry L. Brinks

[57] ABSTRACT

An apparatus and process for extracting sugar from sugar cane in which a blanket of fiberized cane is passed through a series of compression and maceration operations. The compression is performed at low pressures (for example, 40 to 160 pounds per square inch) between a pair of rollers. During compression, the extracted juice is removed through the perforate surface of the lower roller. The extracted juice removed during compression is supplied as imbibition liquid to a prior operation.

20 Claims, 9 Drawing Figures

APPARATUS FOR EXTRACTING SUBSTANCES FROM FIBROUS MATERIALS

This application is a continuation of application Ser. No. 232,690, filed Mar. 8, 1972, abandoned which is a continuation of application Ser. No. 54,370, filed July 30, 1970, abandoned.

This invention relates to a new improved apparatus for removing or extracting, by the use of a suitable solvent or solvents, soluble substances from subdivided fibrous materials as exemplified by the extraction of sugar from sugar cane.

BACKGROUND OF THE INVENTION

Prior commercial processes for removing sugar from sugar cane may be classified generally as tandem mill processes or diffusion processes. In tandem mill processes, the fiberized cane is repeatedly subjected to high pressures, usually in the range of about 1,000 lbs./sq. inch, in order to press the sugar juice from the cane. In diffusion processes, solvent is allowed to percolate through a bed of fiberized cane by gravitational flow for dissolving and extracting the soluble sugar. Many modifications of the foregoing processes, of course, have been made; for example, imbibition liquid ordinarily is utilized in tandem mill processes to improve the extraction efficiencies.

In the past, improvements in tandem mill processes have been in the direction of creating apparatus for exerting higher and higher pressures on the cane in an attempt to increase the extraction efficiencies. This has resulted in higher and higher power requirements, accompanied by increased maintenance costs, and has resulted in increased operational expenses.

The high pressures employed in the conventional tandem mill allows only a small maceration rate. This is because the large juice extraction resulting from the high pressures restricts the amount of maceration. If higher maceration rates could be possible in such tandem mills, the poor drainage area of conventional three-roll mill would be restrictive. A moisture content in bagasse above about 70 percent by weight creates severe feeding problems. Many devices have been developed in an attempt to improve the feeding of such wet bagasse, but with only limited success. In tandem mill processes, the use of high pressures and force feeding devices, therefore, necessarily make such equipment applicable only to materials having a relatively low moisture content.

Sugar cane harvesting methods now are tending toward the incresed use of mechanical equipment. Mechanical harvesting equipment, however, introduces more foreign material into the extraction process, causing increased wear and also increasing the maintenance costs in the high pressure mills.

The diffusion processes require comparatively more elaborate, complex, and expensive equipment than the tandem mill processes, and, therefore, they are economically most feasible in factories having high manufacturing capacities. The extraction efficiencies in the diffusion processes can be higher than for all other available types of extraction equipment, and, for this reason, can be economically justified in many operations. The cane, however, must be specially prepared and exact temperature controls are necessary to prevent adverse bacteriological changes in the sugar during the timer period required for the diffusion operation.

SUMMARY OF THE OBJECTIVES OF THE INVENTION

Accordingly, it is an object of the invention to provide a novel extraction operation for removing soluble substances from fibrous materials and which is adapted to remove sugar from sugar cane.

It it another object of the invention to provide an extraction operation for fibrous materials which has a high amount of maceration, and concomitant therewith, a low extraction time period that is practicable for commercial operations.

It is another object of the invention to provide for effect removal of juice from the bagasse without the use of high pressure rolls at a series of stations in the extraction operation, as for example, by the use of low pressure compression attended by efficient drainage of the extracted juice.

It is another object of the invention to provide a sugar extraction operation that avoids, or reduces, some of the disadvantages of the high pressure mills and diffusers, and yet achieve sufficiently high extraction efficiencies to be competitive therewith.

It is still another object of the invention to provide an extraction operation that is economical in its installation and operational costs, and that requires a minimum of maintenance.

It is yet another object of the invention to provide an extraction operation that is flexible: that can be used to supplement existing facilities; that can be used after a diffuser, in order to improve extraction efficiencies; that can be used to modify high pressure mill systems; or that can be used in new installations.

It is yet another object of the invention to provide an extraction operation that has low power requirements for operation.

Further objects and advantages of this invention will be apparent to one skilled in this field from the following description and accompanying drawings.

DESCRIPTION OF THE PREFERRED EMBODIMENT

Figure 1A:
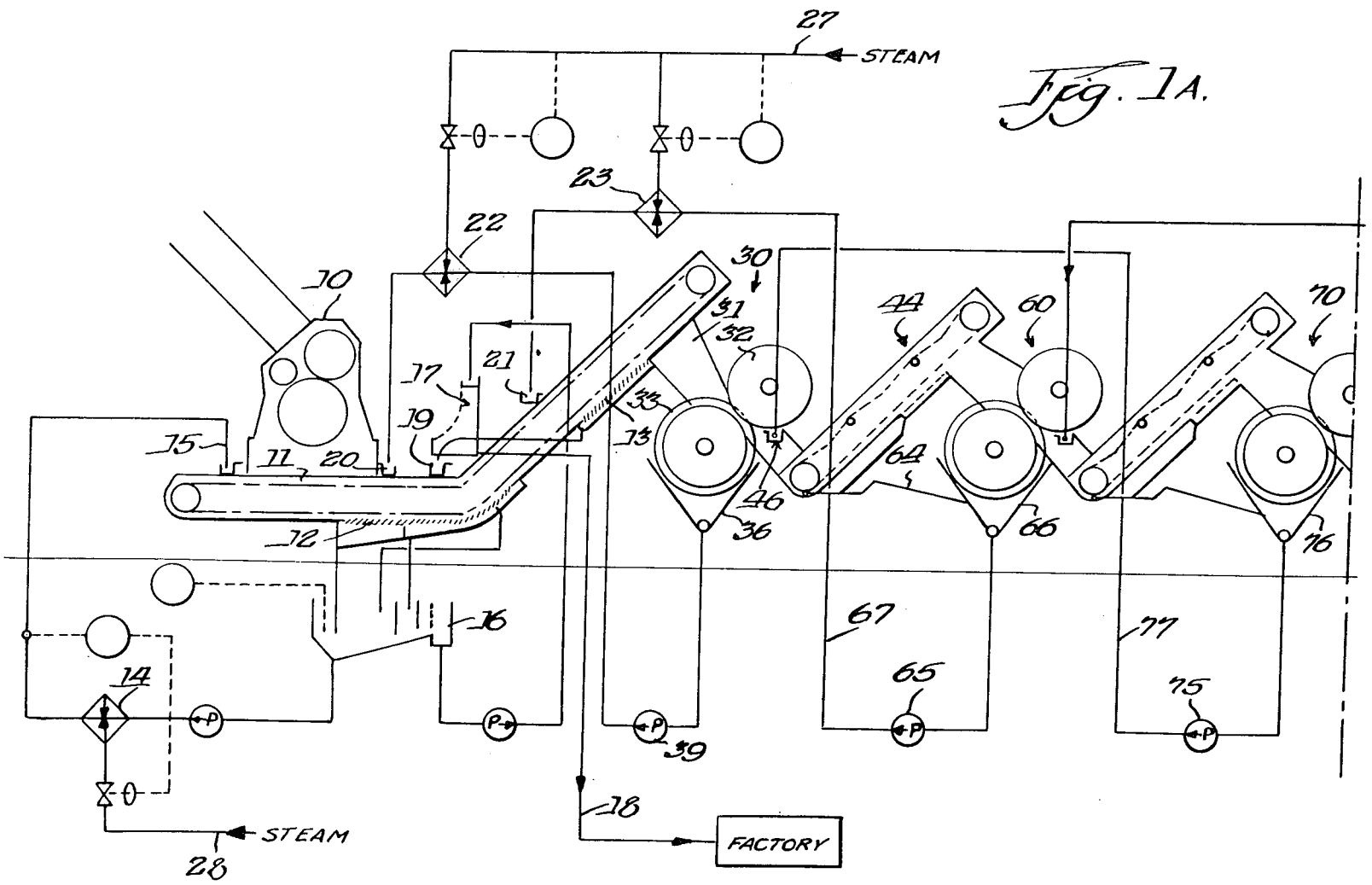
FIG. 1A and 1B are flow sheets diagrammatically illustrating the extraction operation of the invention.

The invention relates to the extraction of soluble substances from subdivided solid fibrous materials, as exemplified by the extraction of sugar from sugar cane.

In the present invention, bagasse having a high moisture content, is supplied to a compression device having a perforate draining surface. The perforate draining surface in the compression device allows compression of bagasse having high moisture contents, for example, moisture contents above about 75% by weight liquid, and at least about substantially saturated with liquid (at least about 85% by weight liquid). The compression of the bed having such high moisture contents may be repeated in order to attain the high extraction efficiencies. The high mositure contents are maintained by introduction of imbibition liquid, maceration, and the like, before the compression operations. Moreover, low pressures are employed in the compression operations in order to maintain the moisture content at these high levels.

The fibrous material when formed into a bed or blanket contains many interstitial spaces. Compression of the bed reduces its volume by reducing the interstitial spacial volume. Removal of the compression allows the bed to return to a full uncompressed volume by increasing the interstitial spacial volume.

The reduction and expansion of the interstitial spacial volume of the bed is used in one preferred embodiment of the present invention as a pumping action for removal and addition of liquid to the fibrous material in the extraction operation. As in a pump in which the atmospheric pressures are utilized to fill an expanding pump chamber, so in one preferred embodiment of the present invention the atmospheric pressures are utilized to introduce liquid into the interstitial spaces of the fibrous bed while expanding in volume.

In the preferred embodiment, the fibrous material is formed into a blanket that is passed through a series of spaced compression stations. The compression stations may be in the form of opposed rollers the lower roller of which has a perforate surface. At each such station the extracted juice is removed by low pressure compression of the bed volume through the performate surface of the lower roller. A series of such stations in which said operations are performed by low pressure devices in tandem is indicated generally by reference numerals 30, 60, 70, 80, 90, and 100 in FIGS. 1A and 1B. The preferred form of low pressure rollers is shown in detail in FIGS. 2 through 8.

Figure 1B:
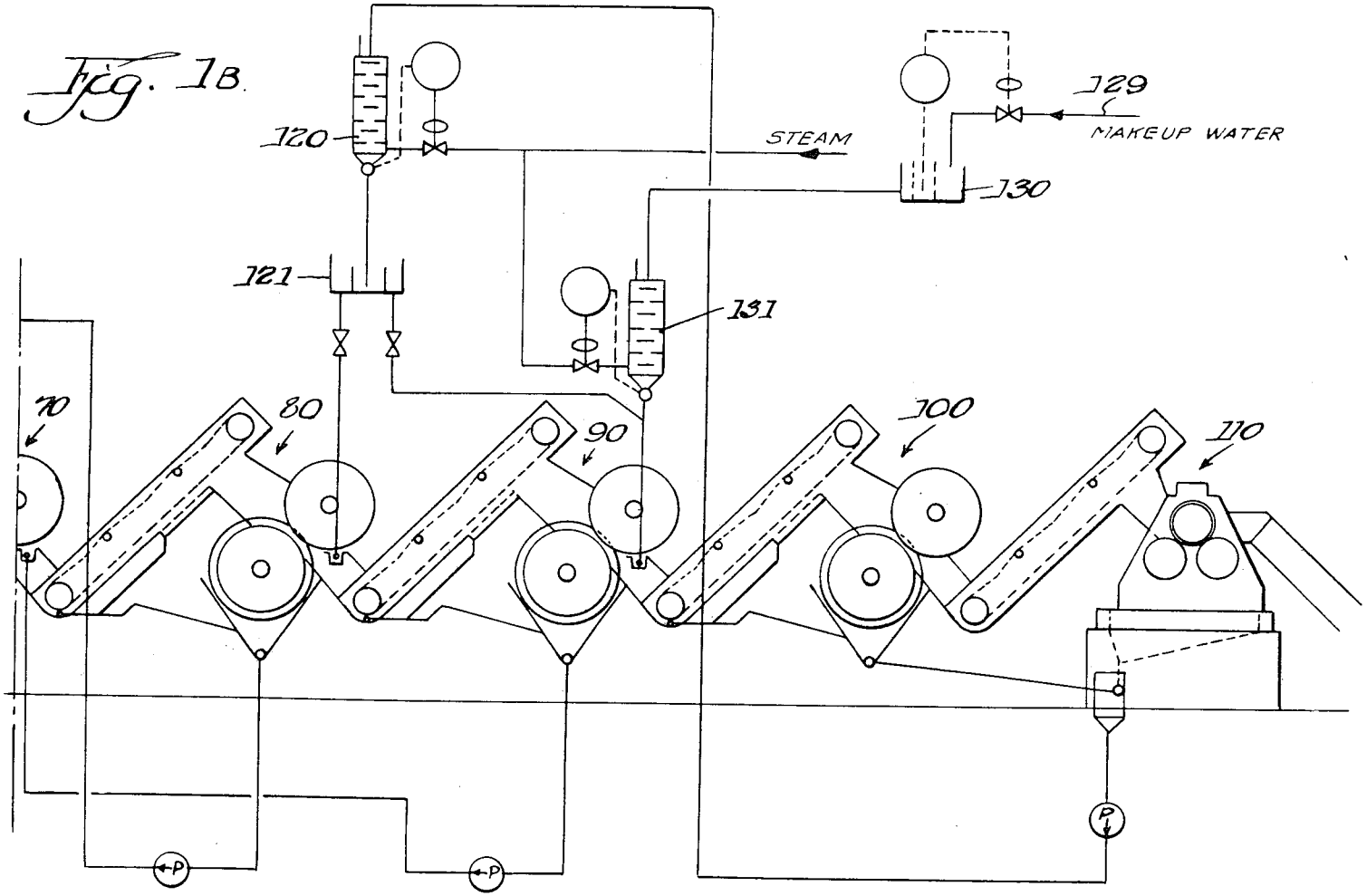

Referring now to FIGS. 1A and 1B, cane is received by conventional equipment, and fed into the fiberizer 10 to prepare the cane for the extraction operation. The fiberizer breaks the cane into short sections and separates the cells from the fiber bundles.

The fiberized cane is fed into a maceration carrier 11 provided with sieve areas 12 and 13 to extract a certain amount of juice, termed recirculating juice. The recirculating juice is warmed by heater 14 and injected again at the top of maceration carrier 11 by distributor 15 for the purpose of heating the cane to the desired diffusion temperatures, for example, about 170° F. A part of the screen or sieve 12 serves to remove the diffusion juice from the maceration carrier which is metered into weir box 16 and pumped to separating screen 17. The separating screen 17 feeds the fines back to the maceration carrier 11 and conducts the separated juice through line 18 to the factory for further processing.

The maceration carrier 11 is also provided with a separating screen 13 in the upper inclined portion near the discharge end for separating the free juice and cane. The juice separated by screen 13 is returned by the distributor 19 to the forward portion of the maceration carrier 11.

The distributors 20 and 21 receive the extracted juice from the first and second low pressure devices 30 and 60, respectively for addition to the maceration carrier 11. This juice is heated by heaters 22 and 23 to the dsired diffusion temperatures before entering the distributors 20 and 21. Steam line 27 supplies heaters 22 and 23. Steam line 28 supplied heater 14.

The cane is fed from maceration carrier 11 to the chute 31 for introduction into the first low pressure device 30. The cane is deposited on the chute 31 which forms a blanket of bagasse that is fed between a pair of compression surfaces. The compression surfaces are cylindrical rollers 32 and 33 that reduce the volume of the bed and extract a certain amount of liquid. The rollers 32 and 33 are motor driven for rotation.

Figure 2:
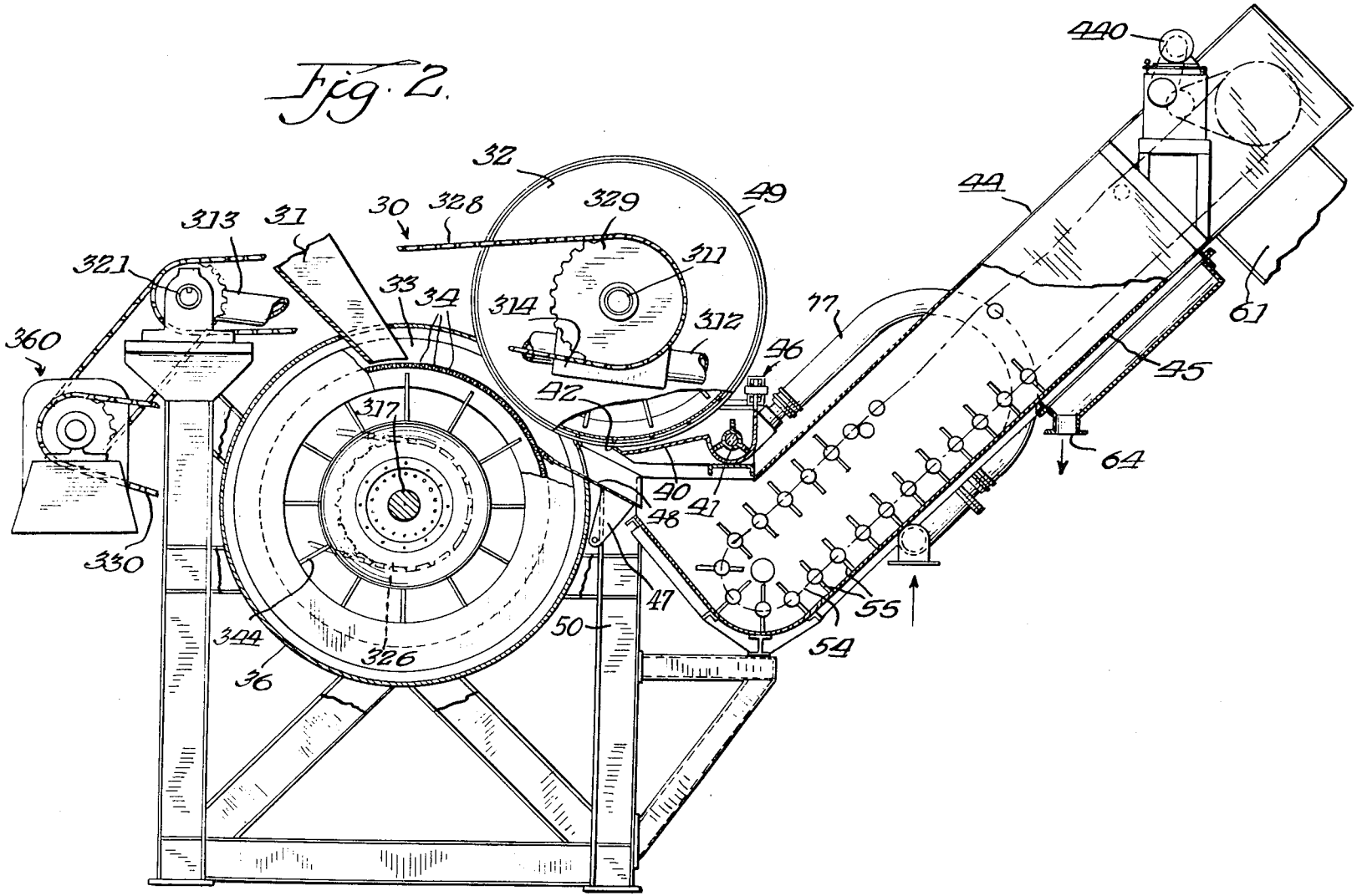
FIG. 2 is a side view in section of one of the low pressure devices and associated parts.

Referring now to FIG. 2, lower roller 33 has perforate openings 34 for draining the extracted juice. The extracted juice is collected in a tray 36 and fed to distributor 20.

Immediately after passing the low pressure device, the extracted cane now called bagasse, will be soaked with imbibition juice in such a way to introduce the juice into the interstitial spaces of the bagasse bed as it is decompressed and expands to its uncompressed volume. Referring to FIGS. 2 and 4, the imbibition juice is fed to the expanding bagasse blanket by a distributing trough 46. The distributing trough may be equipped with a motor driven paddle agitator 41 for suspension of fiber solids in the imbibition liquid. The distributing trough 46 and the guide plate 40 may be one unit which is suspended on the top roller guiding arms 312 and 313 in such a manner that, under all conditions of movement of roller 32 relative to roller 33, proper accommodation to the top roller is maintained. A maceration gap 42 is formed between the forward edge of plate 40 and top roller 32 for delivering imbibition liquid to the bagasse as it leaves the nip between rollers 32 and 33, and before the bagasse has fully expanded to its uncompressed volume. The maceration gap 42, or the distance between the edge of plate 40 and the cylindrical surface of roller 32, is determined by two radially located guiding rings 49 at the ends of top roller 32 and V-shaped chevron bars 43 on the top roller (See FIG. 3).

A scraper plate 48 on the lower roller 33 removes and guides the expanding bagasse blanket emerging from the nip between rollers 32 and 33 to maceration carrier 44 for introducing to the second low pressure device 60. The removal of the bagasse blanket by scraper 48 permits the introduction of the imbibition liquid through the maceration gap 42 at a location immediately after the compression operation and during the expansion of the bagasse blanket which provides the most uniform distribution of the maceration liquid in the bagasse blanket. The scraper blade 48 is mounted on a pair of arms 47 pivotally mounted on the frame 50.

Figure 3:
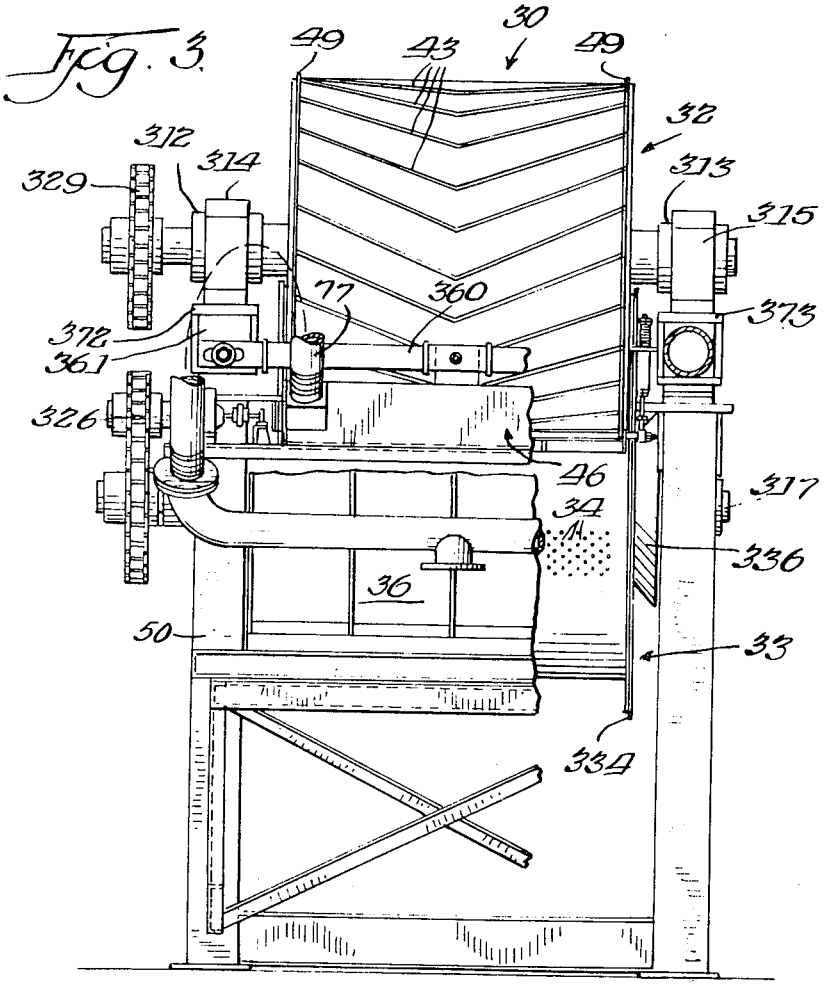
FIG. 3 is an end view of the low pressure device shown in FIG. 2.
Figure 4:
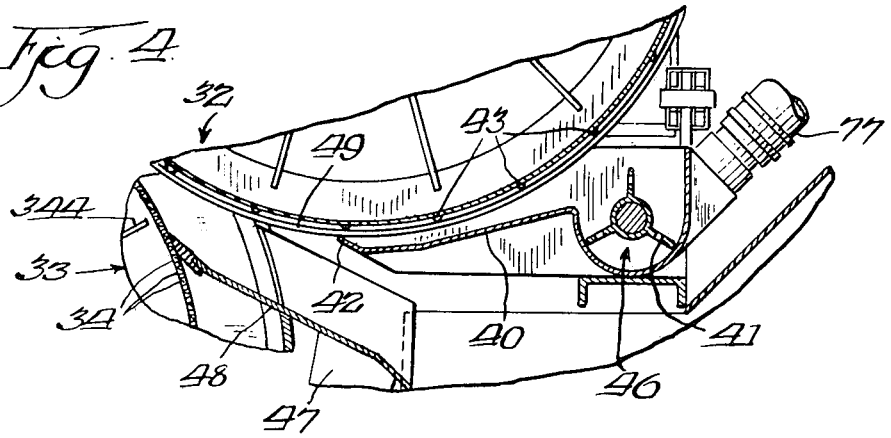
FIG. 4 is an enlarged detailed view of the system for supplying imbibition liquid to the low pressure device.

Referring now to FIG. 3, the cylindrical surface of roller 32 is provided with V-shaped chevron bars 43 which protrude therefrom to assist in feeding of the bagasse to the nip between rollers 32 and 33. The bars 43 also provide means for cleaning macerating gap 42. The imbibition juice supplied to guide plate 40 normally contains a certain amount of fiber particles that may accumulate and block the gap 42. The bars 43 sweep the gap 42 during rotation of the upper roller 32 to remove any such blocking accumulation.

The bagasse on blade 48 is fed by chute 31 to the intermediate maceration carrier 44 to conduct the bagasse to the next low pressure device 60. The carrier 44 is also provided in its upper portion near the unloading gap with a sieve area 45 to separate an excess of imbibition juice and to supply it via line 64 to the tray at the bottom of the next low pressure device 60.

The foregoing procedures can be repeated at a number of low pressures units 60, 70, 80, 90, and 100 in series. The juice extracted from the low pressure units is conducted in counter-current flow to the bagasse bed and introduced as imbibition liquid into a prior operation. As illustrated in the drawings the imbibition liquid flows counter-current to the bed in what is termed multiple compound imbibition, although other techniques for maintaining high moisture contents in the bagasse bed may be used, for example, recycling, either partial or full recycling, of the extracted juices from a compression operation to immediately prior to and in advance of the same compression operation. The extraction juice from low pressure unit 60 (and excess liquid from maceration carrier 44) is collected in tray 66, and conducted via pump 65 and line 67 to distributor 21. Simmilarly, the juice from tray 76 of low pressure unit 70 is fed via pump 75 and line 77 to distributor trough 46 of low pressure unit 30. The pattern for distribution of the extracted juice in the other operations is shown by the indicated lines in FIGS. 1A and 1B.

The low pressure unit 100 can be combined with a conventional three-roll high pressure mill 110 to reduce the moisture content of the bagasse to about 48 to 50 percent by weight. The units 100 and 110 can be replaced by a cone press to obtain the final moisture reduction.

The press water from the dewatering unit 100 and 110 is collected and fed to heater 120 and then to the distributor weir box 121, and finally to the distributing troughs of low pressure units 80 and 90. The make up water supplied by line 129 (usually fed at a rate of 25 percent by weight of the incoming bagasse) is metered to the imbibition line through weir box 130, heated by injection heater 131, and then introduced at the imbibition gap of low pressure unit 90.

The pressure applied in narrowest space between the pressure surfaces of the low pressure units 30, 60, 70, 80, and 90, ordinarily does not exceed about 250 pounds per square inch, and more usually is in the range from 40 to 160 pounds per square inch, in contrast to the high pressure mills that employ pressures above 1000 pounds per square. inch. It is one of the advantages of the invention, therefore, that although low pressures are employed, which require less power to operate, the extraction efficiency, due to a high maceration rate, achieves the substantially same values as by high pressure mills.

Typical operating conditions are illustrated in the following Table. The percentages are by weight.

TABLE 1

| Unit (Referring to FIG. 1) | Liquid in Bagasse Before Pressing Wt. % | Liquid in Bagasse After Pressing Wt. % | Liquid Extracted Wt. % | Moisture Contents of Bagasse: Before Pressing Wt. % | Moisture Contents of Bagasse: After Pressing Wt. % |
|---|---|---|---|---|---|
| 30 | 93.8% | 28.9% | 64.9% | 88.0% | 69.0% |
| 60 | 69.8 | 28.4 | 41.4 | 84.3 | 68.6 |
| 70 | 68.9 | 28.0 | 40.9 | 84.0 | 68.3 |
| 80 | 68.1 | 27.6 | 40.5 | 83.9 | 68.0 |
| 90 | 66.5 | 26.4 | 40.1 | 83.6 | 67.0 |
| 100 | 51.4 (66.5) | 25.2 (25.2) | 26.2 (41.3) | 79.8 (83.6) | 66.0 |
| 110 | 25.2 | 12.5 | 12.7 | 66.0 | 49.0 |

Note: The figures in parentheses after unit 100 are increased by reason of a greater proportion of imbibition water.

The saturation point of the bagasse used for the operation in the above Table was about 84 to 85% by weight. The moisture content of the bagasse before pressing is at least substantially about the saturation point of the bagasse as shown in the foregoing Table. Optimum maceration thereby is achieved.

In order to more fully describe in invention, the low pressure device 30 will now be described in detail. It is understood that the device 30 is typical and low pressure devices 60, 70, 80, 90, and 100 will be of the same general construction.

The bagasse blanket is carried by maceration carrier 11 and dropped into feed chute 31. Feed chute 31 introduces the bagasse between the nip of rollers 32 and 33.

Referring to FIGS. 2 and 3, the upper roller 32 rotates on shaft 311 and is journalled in self-aligning adjustable bearings 314 and 315. The upper roller 32 is supported on two independently pivotable arms 312 and 313. At one end of the arms 312, 313, are mounted support bearings 314 and 315. The other end of the arms 312, 313, are pivotally mounted on axis 321. The independently pivotable support arms 312 and 313 permit the upper roller 32 to adjust to density variations in the bagasse blanket passing between upper roller 32 and lower roller 33 by providing for the pivoting movement of upper roller 32 about pivot axis 321 at the end of the support arm (see FIG. 2).

Lower roller 33 rotates on shaft 317 journalled in stationary bearings. Motor assembly 360 is used to drive lower roller 33 by means of a chain drive 330 connected to sprocket 326. Similarly, the same or a separate motor assembly is used to drive sprocket 329 through a chain drive 328 to rotate upper roller 32.

As can be seen in FIG. 3, lower perforated roller 33 is axially longer than upper roller 32 so that the upper roller can fit between rings 334 on the outer periphery of lower roller 33. The rings 334 are provided for lower roller 33 to assure that the bagasse blanket being passed between the upper and lower rollers does not spill over the side of lower roller 33. Water deflector plates 336 are provided at each end of lower roller 33 to prevent the extracted juice, which enters the interior of the lower roller 33 through the perforate surface 34 during compression, from splashing onto adjoining surfaces.

Figure 5:
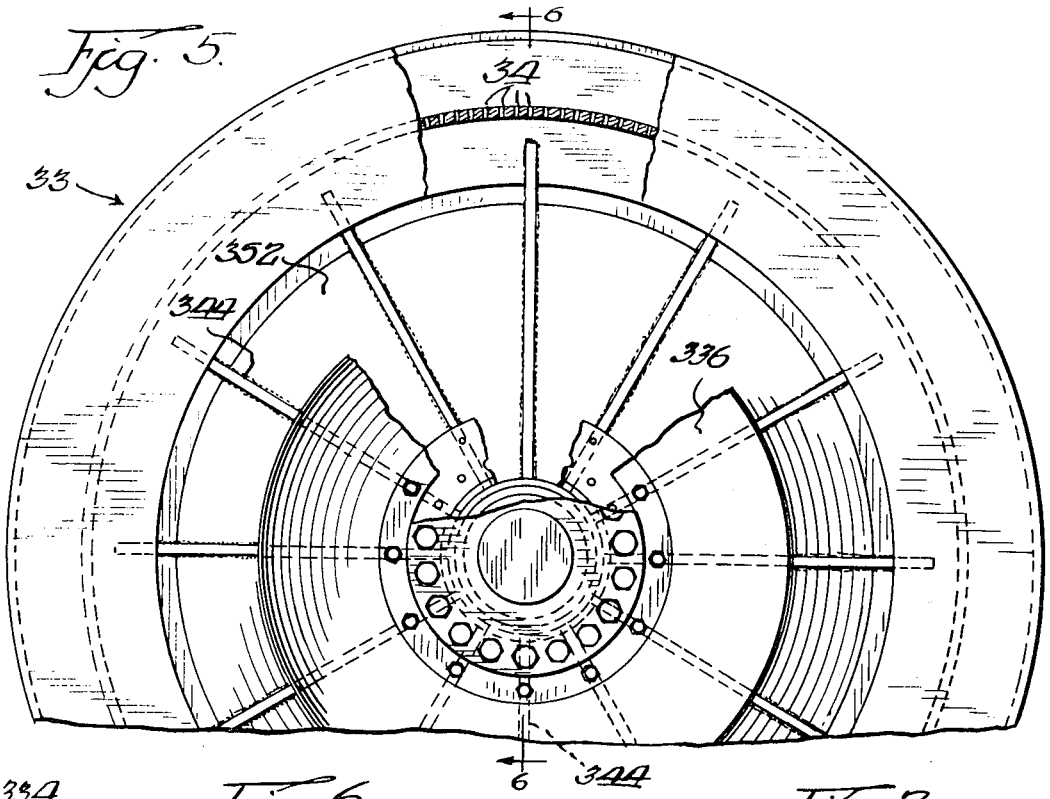
FIG. 5 is an end view partly in section of the lower roll of the low pressure device shown in FIG. 2.
Figure 6:
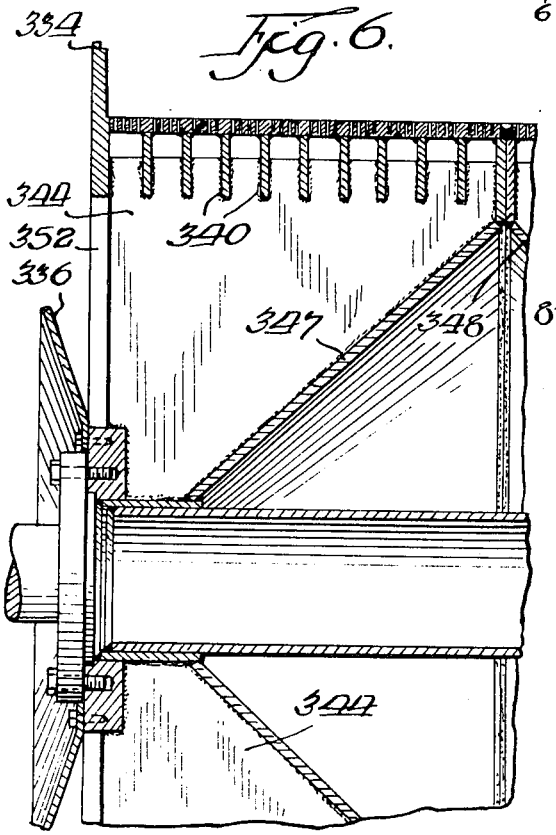
FIG. 6 is a fragmentary sectional view taken along line 6—6 in FIG. 5.

Both the upper roller 32 and lower roller 33 are provided with a series of interior reinforcing rings to strengthen the outer working surfaces of the rollers. Referring to FIG. 5 and 6 which illustrate the lower roller 33, there is illustrated reinforcing rings 340 on the interior of the cylindrical surface. Also, the interior of each roller is made up of a series of ribs in the form of plates 344, which are spaces circumferentially about the longitudinal axis of each roller and which similarly strengthen the outer working surfaces of the upper and lower rollers. Normally at least twelve plates, shown only as 344 in the drawings, are spaced at equal distances apart, and surround each cone half in the upper and lower roller. Two frusto-conical assemblies 347 and 348 are mounted on the plates 344 and on the longitudinal shaft of each roller, so as to define a hollow chamber for each roller. During rotation of upper roller 32 and lower roller 33, the juice, which is pressed from the bagasse, passes through openings 34 in the surface of the lower roller 33 and into the interior of the lower roller 33, then is conducted by the frusto-conical plates 347, 348, outwardly through opening 352 into collecting chamber 36 located at the bottom of the lower roller. The juice removed from the bagasse accumulates in collecting chamber or tray 36 from which it is removed by pump 39 (FIG. 1A) and delivered to heater 22 and to distributor 20. The bagasse which has been passed between upper roller 32 and lower roller 33 passes out over scraper blade 48 into maceration carrier 44.

In FIG. 2 the preferred orientation of upper and lower rollers 32 and 33 and feed chute 31 is shown. Upper roller 32 can be offset from a vertical orientation in relation to lower roller 33 by an offset angle of 30° to 60° from vertical so that the bagasse is fed through the nip at a downwardly inclined angle. Although the apparatus of this invention is fully operable when offset angles of 30° to 60° are employed, an orientation in which the upper roller is offset by an angle of 45° from vertical is preferred because of the resultant mechanical advantages. In addition, it is desirable that the feed chute 31 be disposed at an angle of about 42° to about 45°, preferably at about 43°, from a horizontal orientation so that the bagasse blanket will have a tendency to slide down the feed chute as rollers 32 and 33 grip the material.

Offset angle as defined herein means the angle measured between a vertical plane through the longitudinal axis of the lower roller 33 and the plane through longitudinal axes of the upper and lower rollers 10 and 16. In FIG. 2, for example, upper roller 32 is shown at an offset angle of 45° from vertical.

Figure 7:
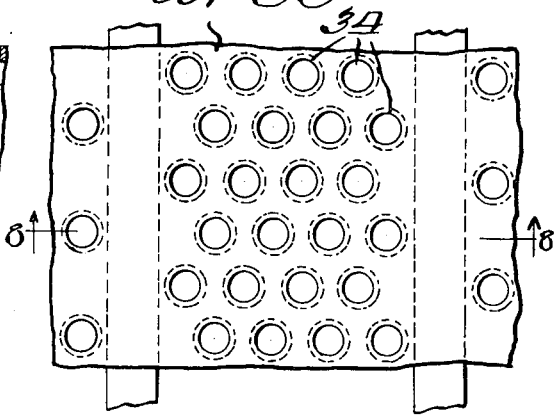
FIG. 7 is an enlarged fragmentary view of the perforate surface of the lower roll.
Figure 8:
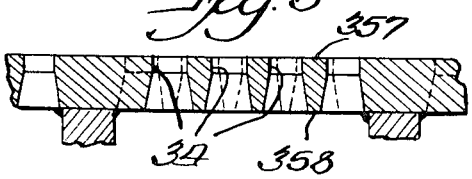
FIG. 8 is a sectional view taken along line 8—8 of FIG. 7.

FIGS. 5–8 provide a more detailed illustration of the lower roller 33. As shown by FIGS. 7 and 8, the surface of lower roller 33 is provided with a plurality of openings 34 equipped to receive juice removed from the bagasse. The openings 34 in the lower roller have a slightly smaller diameter at the top surface 357 of the roller shell than at the lower portions 358 of the roller shell. This sloping shape for openings 34 makes them self-cleaning during operation, since the juice forced through the openings 34 removes any residue collecting on the sides of the openings.

FIGS. 5 and 6 show in detail the position of rings 334 on the outer periphery of the lower roller and the deflector plate 336 which prevents splashing of juice on the lower roller 33. Reinforcing rings 340 and plates 344 used to strengthen the shell of the roller are also shown.

As will be noted from FIG. 6, extracted juice passes through openings 34 and is directed into the compartmentalized chambers defined by the spaced plates 344, then passes along the surfaces of frusto-conical assemblies 347, 348, and finally passes through openings 352 into the collecting tray 36.

The shell of upper roller 32 can be filled with varying amounts of types of liquids, so that the compression of the bagasse can be changed to meet varying processing conditions. Liquid, for example, water, is introduced into the shell of the upper roller 32 through a bolted hatch (not shown) located in the side wall of the roller. The ultimate pressure transmitted to the bagasse passing between upper roller 32 and lower roller 33, therefore, results from both the normal weight of the upper roller 32 and its mounting, plus the added weight of the liquid filling the upper roller. Thus, the upper roller can function as a hydraulic pressure transmitting means.

Referring now to FIG. 3, the arms 312, 313 supporting the upper roller 32 rest on pads 372, 373, respectively, of the supporting frame for the device. The arms are lifted from the pads, however, when the bagasse blanket passing between the rollers is of sufficient density and thickness to lift the upper roller 32. If the upper roller 32 is lifted it swings on arms 312, 313, about pivot point 321. (FIG. 2)

Referring now to FIG. 2, the maceration carrier 44 has a movable conveyor 54 with flights 55 driven by a suitable motor and drive assembly 440 for moving the bagasse blanket to chute 61 for introduction into the next low pressure device 60. The excess maceration juice overflows through sieve 45 and is conducted by line 64 to the collecting tray 66 below the device 60 for counter-current flow via pump 65 to distributor 21.

Referring now to FIG. 3, the support structure for the distribution trough 46 will be described. The distribution trough 46 is suspended on cross-brace 360 which projects beyond the ends of the upper roller 32. The cross-brace 360 is secured at each end to arms 312, and 313 by downwardly projecting legs 361. In this manner the trough 40 is maintained at the same relative position with respect to upper roller 32. As the upper roller 32 moves due to varying densities of bagasse fed to the nip, the trough 46 will be carried therewith. Referring to FIG. 2, the imbibition liquid from the trough is carried by plate 40 to a point adjacent the nip between rollers 32, 33, so as to be deposited upon the bagasse blanket before it has fully decompressed. The imbibition liquid flows over the forward edge of the plate 40 through the gap 42 between plate 40 and the surface of upper roller 32.

From the foregoing, the advantages of the invention should be apparent. The low pressure employed in the compression operations demand low power consumption; significantly lower, for example, than the power requirements of the conventional high pressure mills. A high maceration rate is attained by a unique system without the usual delays that ordinarily cause an extension of the extraction time.

Moreover, the maceration and compression units cannot only be used in new installations, but they can be used with existing extraction systems; for example, to supplement diffusers. The individual units, therefore, are highly adaptable.

The forms of this invention herein disclosed are illustrative and are given only by way of example. The scope of the invention is not to be limited thereby as it is intended that the appended claims be construed as braodly as may be permitted by the prior art.

We claim:

1. In an apparatus for extracting soluble substances from sugar cane, the combination comprising:

means for fiberizing the sugar cane so as to substantially expose the cane juice, means for collecting the fiberized mass of cane, a first compressing means for expressing liquid contained in said fiberized mass, said compressing means having opposed upper and lower compression surfaces, said lower compression surface provided with openings therein for conducting a substantial portion of the expressed liquid therethrough during the compressing operation, means for macerating the fiberized mass prior to said first compressing means, means for supplying said maceration means with liquid expressed from said first compressing means, and means for removing liquid from said maceration means for supply to the final product.

2. In an apparatus according to claim 1, in which said compressing means comprises upper and lower rollers, the lower roller being provided with surface openings for drainage of the extracted liquid therethrough.

3. In the apparatus according to claim 1 which further includes means for heating said macerating means for raising the temperature of the liquid therein.

4. The apparatus according to claim 1 which further includes a plurality of said compressing means in tandem.

5. The apparatus according to claim 1 in which an imbibition liquid is introduced on the downstream side of said first compressing means.

6. The apparatus of claim 5 in which said imbibition liquid is introduced into said bed by means positioned at a location after and adjacent said compressing means before the bed is allowed to expand to its fully uncompressed volume and for introducing liquid into the interstitial spaces of said fibrous material with said imbibition liquid as said bed expands from the compressed volume to the uncompressed volume.

7. In an apparatus according to claim 1 which is further comprising by additional compressing means following said first compressing means, said additional compressing means having the same structure as said first compressing means, additional maceration means for each of said additional compressing means, and means for introducing the juice expressed from each of said additional compressing means to a preceding maceration means.

8. In an apparatus according to claim 7 which is further comprising in removing excess liquid from said additional maceration means and supplying to a prior maceration means.

9. In an apparatus for extracting soluble substances from sugar cane, the combination comprising:

means for fiberizing the sugar cane so as to substantially expose the cane juice, means for collecting the fiberized mass of cane, opposed upper and lower roller compression surfaces, said lower roller provided with openings therein for conducting is substantial portion of the expressed liquid therethrough during the compressing operation, means for macerating the fiberized mass prior to said first compressing means, means for supplying said maceration means with liquid expressed from said first compressing means, and means for removing liquid from said maceration means for supply to the final product.

10. In an apparatus according to claim 9, in which said compressing means comprise upper and lower rollers, the lower roller being provided with surface openings for drainage of the extracted liquid therethrough.

11. In the apparatus according to claim 9 which further includes means for heating said macerating means for raising the temperature of the liquid therein.

12. In an apparatus according to claim 9 in which said macerating means is heated for raising the temperature of the liquid therein.

13. The apparatus according to claim 9 which is further comprising by additional compressing means following said first compressing means, said additional compressing means having the same structure as said first compressing means, additional maceration means for each of said additional compressing means, and means for introducing the juice expressed from each of said additional compressing means to a preceding maceration means.

14. The apparatus according to claim 9 which further includes a plurality of said compressing means in tandem.

15. In an apparatus according to claim 9 which is further comprising in removing excess liquid from said additional maceration means and supplying to a prior maceration means.

16. The apparatus according to claim 9 in which an imbibition liquid is introduced on the downstream side of said first compressing means.

17. The apparatus of claim 16 in which said imbibition liquid is introduced into said bed by means positioned at a location after and adjacent said compressing means before the bed is allowed to expand to its fully uncompressed volume and for introducing liquid into the interstitial spaces of said fibrous material with said imbibition liquid as said bed expands from the compressed volume to the uncompressed volume.

18. The apparatus of claim 9 which further includes means positioned on the downstream side of the nip of said roller compression means for introducing imbibition liquid as it expands from the compressed volume between the nip of said rollers to the uncompressed volume.

19. In an apparatus according to claim 18 in which said latter means comprises a weir extending longitudinally along the nip of said upper and lower rollers, said weir having a draining edge positioned adjacent to the surface of said upper roller.

20. In an apparatus according to claim 19 in which said upper roller is further provided with means for cleaning the gap between said draining edge of the weir and said upper roller.

* * * * *